US006322351B1

(12) United States Patent
Christensen et al.

(10) Patent No.: US 6,322,351 B1
(45) Date of Patent: Nov. 27, 2001

(54) BURNER FOR USE IN CORROSIVE ATMOSPHERE AND PROCESS FOR THE COMBUSTION OF HYDROCARBON FUEL THEREIN

(75) Inventors: Thomas Sandahl Christensen, Lyngby; Ivar Ivarsen Primdahl, Copenhagen; Olav Holm-Christensen, Copenhagen; Peter Seier Christensen, Copenhagen, all of (DK)

(73) Assignee: Haldor Topsoe A/S, Lyngby (DK)

( * ) Notice: Subject to any disclaimer, the term of this patent is extended or adjusted under 35 U.S.C. 154(b) by 0 days.

(21) Appl. No.: 09/393,710

(22) Filed: Sep. 10, 1999

Related U.S. Application Data

(60) Provisional application No. 60/100,460, filed on Sep. 15, 1998.

(51) Int. Cl.[7] ..... F23D 14/76

(52) U.S. Cl. ..... 431/3; 431/160; 239/424

(58) Field of Search ..... 431/2, 3, 4, 8, 431/159, 160, 181; 110/260, 261; 239/132.5, 426, 434, 424

(56) References Cited

U.S. PATENT DOCUMENTS

| | | | | |
|---|---|---|---|---|
| 733,579 | * | 7/1903 | Fitton | 239/426 |
| 4,986,748 | * | 1/1991 | Brown et al. | 239/424 |
| 5,496,170 | * | 3/1996 | Primdahl et al. | 431/181 |
| 5,515,794 | * | 5/1996 | Kassman et al. | 110/260 |
| 6,193,173 | * | 2/2001 | Bodelin et al. | 239/424 |

FOREIGN PATENT DOCUMENTS

| | | | | |
|---|---|---|---|---|
| 60-171310 | * | 9/1985 | (JP) | 431/8 |

* cited by examiner

*Primary Examiner*—Sara Clarke
(74) *Attorney, Agent, or Firm*—Ostrolenk, Faber, Gerb & Soffen, LLP

(57) ABSTRACT

Process for the combustion of hydrocarbon fuel in a burner being exposed to corrosive atmosphere, wherein outer surface of the burner being protected by passing a non-corrosive atmosphere along the outer burner surface.

5 Claims, 1 Drawing Sheet

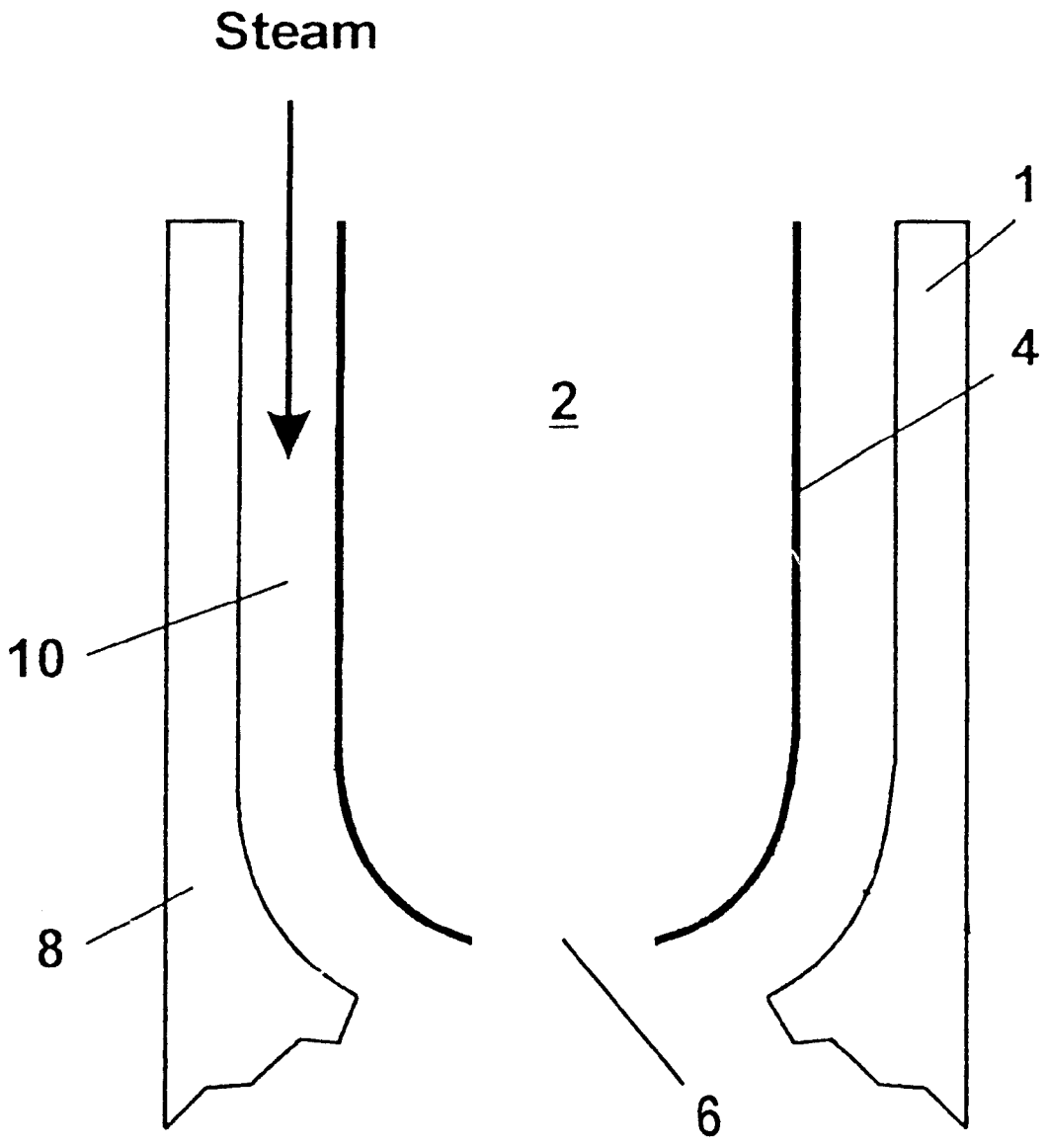
Steam
1
4
2
10
8
6

BURNER FOR USE IN CORROSIVE ATMOSPHERE AND PROCESS FOR THE COMBUSTION OF HYDROCARBON FUEL THEREIN

This application claims the benefit of U.S. Provisional application Ser. No. 60/100,460 filed Sept. 15, 1998.

BACKGROUND OF THE INVENTION

1. Field of the Invention

The present invention is directed to combustion of hydrocarbon fuel in a burner and a device for carrying out the combustion process.

2. Description of the Related Art

Hydrocarbon fuel is in the chemical industry usually used in the firing of industrial furnaces and process heaters and to supply heat to heat requiring reactions proceeding in reaction vessels provided with appropriate burners.

A general drawback of the known burners is damage of the burner face at high fuel gas velocities, as required for industrial burners and metal dusting caused by corrosive atmosphere to which the burner's surface is exposed at high temperatures.

U.S. Pat. No. 5,496,170 discloses a swirling flow burner with improved design to prevent hot combustion products from internal recycling through a combustion adjacent to the burner face. Thereby, damage of the burner face caused by the hot combustion products is substantially prevented.

SUMMARY OF THE INVENTION

It has now been observed that metal dusting and carburization of industrial burners being subjected to corrosive atmosphere is substantially avoided when directing a protective atmosphere along the outer surface and face of the burner body in an amount sufficiently to dilute or displace the corrosive atmosphere around the burner surface.

Accordingly, this invention is a process for the combustion of hydrocarbon fuel in a burner being exposed to corrosive atmosphere, wherein a non-corrosive atmosphere is passed along outer surface of the burner to protect the surface from contact with the corrosive atmosphere. Suitable non-corrosive atmosphere will be any gaseous medium, which does not cause metal dusting or carburization reactions on metallic surfaces at elevated temperature.

Suitable non-corrosive atmospheres included steam $H_2$, $CO_2$ and nitrogen or mixtures thereof.

Furthermore, the invention provides a burner for the combustion of hydrocarbon fuel with an oxidant comprising within an outer metallic surface passages for supplying fuel and oxidant, and an orifice for combustion of the fuel with the oxidant, the improvement comprising a wall concentrically and spaced apart surrounding at least part of the outer metallic surface of the burner and being adapted to introduce and passing a protective atmosphere along the surface.

When operating the above burner in a reactor, the wall may be formed by refractory lining material at top of the reactor surrounding the outer surface of the burner in a suitable distance and, thereby, forming passageway for introduction and passage of the protective atmosphere during operation of the burner.

BRIEF DESCRIPTION OF THE DRAWINGS

The following description shows more detailed a specific embodiment of the invention by reference to the drawing in which the sole FIGURE shows a sectional view of an inventive burner mounted in a refractory lined reactor top.

DETAILED DESCRIPTION OF THE PREFERRED EMBODIMENT

A burner 2 having an outer surface with cylindrical metallic surface 4 and a conical metallic orifice 6 is mounted in top part of a reactor 1. An annular space 10 between upper surface 4 and part of orifice 6 is formed between the burner surface and a refractory lining 8 in burner 1. Through annular space 10 steam is passed along upper surface 4 and directed to orifice 6. The steam being passed through annular space 10 protects the outer surface from corrosive combustion atmosphere and prevents carburization or metal clusting reaction the surface caused by the combustion atmosphere.

EXAMPLE

In an autothermal reformer (ATR) pilot plant different embodiments of the process according to the invention were carried out by use of a burner type as disclosed in U.S. Pat. No. 5,496,170. The burner has been protected against metal dusting on the burner outer wall with a stream of steam flowing in a sleeve surrounding the burner. The outer nozzle of the burner was made from an alloy, which in preliminary experiments has shown to be attacked by metal dusting without the presence of the protecting flow of steam on the outside. At the same time, the performance of the individual burners regarding soot formation was tested by determination of the critical temperature for a certain steam to carbon ratio (S/C). The critical temperature was found in each test by gradually lowering the exit temperature of the reactor ($T_{Exit}$) until the soot limit was surpassed. The value was, furthermore, determined for a burner without a protecting steam flow at otherwise identical conditions i.e. inlet flow, operational pressure and steam carbon ratio. The steam to carbon ratio (S/C) is defined as the sum of all steam feeds in moles divided by the sum of hydrocarbons in moles of carbon atoms ($C_1$). The pilot plant used in the above tests comprises units for providing the different feed streams to the ATR reactor, the ATR reactor and equipment for post treatment of the product gas. The feed streams consisted of natural gas, steam, oxygen and hydrogen. All gases were compressed to operating pressure and preheated to operating temperature. An average composition of the natural gas is given in Table 1. The natural gas was desulphurised before introduction into the ATR reactor. The feed streams were combined into three steams and passed to the burner of the ATR. A first feed stream of natural gas, hydrogen and steam was preheated to a temperature of about 500° C.

A second feed stream containing oxygen and steam was preheated to between 200° C. and 220° C. A third feed stream consisting only of steam was heated to 450° C.

In the ATR reactor, a sub-stoichiometric combustion and subsequent catalytic steam reforming and shift reactions were carried out. The inlet and exit gas compositions were analysed by gas chromatography. The product gas was in equilibrium with respect to reforming and shift reactions. Downstream the ATR reactor, the process gas was cooled and the majority of the steam content of the product gas condensed.

TABLE 1

| Component | Mole fraction % |
|---|---|
| $N_2$ | 0.45 |
| $CO_2$ | 1.20 |
| $CH_4$ | 95.36 |
| $C_2$ | 2.22 |
| $C_3$ | 0.45 |
| $C_4$ | 0.23 |
| $C_5$ | 0.08 |

Two tests were carried out using a burner made from commercial alloy Haynes-230. This alloy was previously tested without a protecting flow of steam on the burner outer wall at operation conditions with a steam carbon ratio of 0.35 and 0.6, whereby the outside of the burner was attacked by metal dusting after approximately 155 operation hours.

The corresponding operation conditions at tests with protection of steam according to the invention are summarised in Table 2 below.

The above burner type was tested for limits for soot formation without having steam in the steam sleeve by reference experiments "SP S/C 0.60 ref." and "SP S/C 0.35 ref." summarised below in Table 3. The soot limit was then investigated, when a certain portion of the steam was passed through the steam sleeve along the outer wall of the burner. The operational conditions for the soot performance test together shown in Table 3 together with the critical temperatures ($T_{critical}$) characterising the soot performance of the burner.

TABLE 2

| Experiment | NG Nm3/h | H2 Nm3/h | S/C – | Stream in sleeve Nm3/h | P Exit bar g | T Exit ° C. | T Inlet, 1 ° C. | T Inlet, 2 ° C. | Hours of stream |
|---|---|---|---|---|---|---|---|---|---|
| MD S/C 0.60 | 100 | 2.0 | 0.60 | 5.0 | 27.5 | 1020 | 500 | 220 | 163 |
| MD S/C 0.35 | 100 | 2.0 | 0.35 | 3.5 | 27.5 | 1020 | 499 | 222 | 183 |

Metal dusting test are carried out at a steam to carbon ratio (S/C) of 0.60 (MD S/C 0.60) and 0.35 (MD S/C 0.35), respectively. The operating conditions are summarised in Table, where $T_{Inlet,1}$ and $T_{Inlet,2}$ are the inlet temperatures of the first and second feed streams, respectively, and $T_{Exit}$ and $P_{Exit}$ are the temperature and the pressure of the gas leaving the reactor, at which conditions the steam reforming and shift reactions are in equilibrium.

After each test, the burner is removed from the ATR reactor for inspection. While the burner without protecting steam flow on the outer wall showed region on the surface being corroded by metal dusting on the outside surface of the gas nozzle, the outside nozzle of the burners with protection steam showed no sign of metal dusting on the outer surface.

TABLE 3

| Experiments | NG Nm3/h | H2 Nm3/h | S/C – | P Exit | T critical | T Inlet, 1 ° C. | T Inlet, 2 ° C. | Steam in sleeve Nm3/h |
|---|---|---|---|---|---|---|---|---|
| SP S/C 0.60 ref. | 100 | 2.0 | 0.60 | 27.5 | 950–960 | 500 | 220 | 0 |
| SP S/C 0.35 ref. | 100 | 2.0 | 0.35 | 27.5 | 987–988 | 500 | 200 | 0 |
| SP S/C 0.60 #1 | 100 | 2.0 | 0.60 | 27.5 | 947–952 | 499 | 196 | 5.0 |
| SP S/C 0.60 #2 | 100 | 2.0 | 0.60 | 27.5 | 947–951 | 503 | 220 | 12 |
| SP S/C 0.35 #1 | 100 | 2.0 | 0.35 | 27.5 | 986 | 499 | 219 | 3.5 |
| SP S/C 0.35 #2 | 100 | 2.0 | 0.35 | 27.5 | 987 | 489 | 205 | 12 |

Operation conditions and critical temperatures ($T_{critical}$) for soot performance experiments (SP) including reference experiments without steam in the steam sleeve.

To investigate the soot performance of the burner, four experiments have been made to determine the critical temperature ($T_{critical}$) for operation with a steam flow in the steam sleeve. The four experiments are performed at steam-carbon ratio 0.60 and 0.35 as shown in Table 3, where the critical temperature ($T_{critical}$) is shown as well. The steam flow in the sleeve was varied as well as the steam flow to the first feed stream in order to keep the total steam flow to the process constant. The results are compared with results for burners of the same type operated without a steam sleeve- (reference tests). There was not found any significant difference tests. Thus, operation with a steam flow in a steam sleeve on the outside of the burner in an amount corresponding to 8–35% of the total amount of steam introduced into the process does not influence the performance of the burner with respect to soot formation.

Although the present invention has been described in relation to particular embodiments thereof, many other variations and modifications and other uses will become apparent to those skilled in the art. Therefore, the present invention is to be limited not by the specific disclosure herein, but only by the appended claims.

What is claimed is:

1. A process for the partial oxidation of hydrocarbon fuel in a burner exposed to metal dusting by contact with combustion products from the partial oxidation of hydrocarbon fuel said process comprising providing a passageway for a non-corrosive atmosphere along the outer surface of the burner by surrounding the outer surface of the burner with a refractory lining spaced apart from the outer surface, and passing a non-corrosive atmosphere through the passageway and along the outer surface of the burner.

2. The process of claim 1, wherein the non-corrosive atmosphere consists of steam, $H_2$, $CO_2$, nitrogen or mixtures thereof.

3. The process of claim 1, wherein the hydrocarbon fuel is combusted together with steam.

4. The process of claim 2, wherein the non-corrosive atmosphere consists of steam.

5. The process of claim 3, wherein at least part of the atmosphere steam is added to the hydrocarbon fuel.

* * * * *